United States Patent [19]

Köhler

[11] 4,357,964

[45] Nov. 9, 1982

[54] THREADED LIGHT METAL GRIPPER WITH REINFORCEMENT RIB

[75] Inventor: Lothar Köhler, Tann-Rüti, Switzerland

[73] Assignee: Rüti Machinery Works Ltd., Rüti, Switzerland

[21] Appl. No.: 179,105

[22] Filed: Aug. 18, 1980

[30] Foreign Application Priority Data

Sep. 5, 1979 [CH] Switzerland ..... 8030/79

[51] Int. Cl.[3] ..... D03D 47/20

[52] U.S. Cl. ..... 139/448

[58] Field of Search ..... 139/447, 448, 440, 443, 139/446

[56] References Cited

U.S. PATENT DOCUMENTS

| | | | |
|---|---|---|---|
| 3,077,905 | 2/1963 | Remington | 139/447 |
| 3,081,797 | 3/1963 | Flamand | 139/447 |
| 3,613,740 | 10/1971 | Geiger | 139/448 |
| 4,040,454 | 8/1977 | Genini | 139/448 |

*Primary Examiner*—Henry Jaudon

*Attorney, Agent, or Firm*—Werner W. Kleeman

[57] ABSTRACT

At an insertion element of a gripper loom possessing a gripper and a flexible insertion band or tape which drives such gripper, there is arranged a reinforcement element at the region of the insertion band which merges with the gripper, this reinforcement element being connected by screws or the like with the insertion band. The gripper is connected on the one hand with the reinforcement element and, on the other hand, with the insertion band likewise by screws. The gripper consists of a material having a lower specific weight or density in relation to steel and is provided at the region of its clamp member which fixedly clamps the filling thread with an insert or insert member formed of a wear-resistant material. Due to this design there are realized high stability of the insertion element, low fabrication and assembly cost, and a possibility of increasing the rotational speed of the loom owing to reduced mass of the gripper.

11 Claims, 7 Drawing Figures

II
III
IV
IV

THREADED LIGHT METAL GRIPPER WITH REINFORCEMENT RIB

CROSS-REFERENCE TO RELATED CASES

This application is related to the commonly assigned co-pending U.S. application Ser. No. 8543, filed Feb. 1, 1979, of Hans Zollinger, entitled "WITHDRAWING CARRIER FOR LOOMS WITH REMOVAL OF THE FILLING THREAD FROM STATIONARY BOBBINS", and also is related to the commonly assigned, co-pending U.S. application Ser. No. 06/179,105, filed Aug. 18, 1980 of Erhard Freisler, entitled "GRIPPER HEAD FOR LOOMS WORKING WITH REMOVAL OF THE FILLING THREAD FROM STATIONARY BOBBINS".

BACKGROUND OF THE INVENTION

The present invention relates to a new and improved construction of a filling-thread insertion element for looms working with removal of the filling thread from stationary bobbins or spools. The filling-thread insertion element of the invention is of the type comprising a flexible insertion band or tape, a gripper driven by such insertion band, this gripper being provided with a clamp element or clamp for fixedly clamping the filling or weft thread, and with a reinforcement element arranged at the insertion band at its region merging with the gripper.

With state-of-the-art band gripper looms of this type there is arranged to both sides of the loom a respective band or tape wheel, at which there is secured the respective end of an insertion band or tape. At the other end of each insertion band there is mounted a gripper for the insertion of the filling threads. The insertion bands are oscillatingly driven by the band wheels, and thus, are continuously and alternately wound-up and wound-off the band wheels. Thus, particularly at the region of attachment locations of the gripper with the insertion bands there arise bending loads which are predicated upon flutter or oscillatory movements of the gripper heads, and these bending loads can lead to rupture.

To reduce the danger of such rupture and for stabilizing the gripper travel or operation, it has already been proposed to provide the insertion bands with a reinforcement at their end supporting the gripper. One such prior art solution resides in providing the insertion bands, at the aforementioned end, with a transverse domed or arched portion, and according to another known solution the insertion bands are uniformly connected at their end region with a reinforcement strip.

Practical tests undertaken on equipment designed according to these proposals have shown that these solutions have not been capable of completely eliminating the flutter movements of the equipment, and furthermore, the aforementioned rupture or fracture still occurs. Additionally, it has been found that with increasing frequency of the filling-thread insertion operations the grippers are deflected at the reversal points of their movement out of their horizontal path of travel. At the outer reversal of turning point, in other words at the start of a filling-thread insertion, the grippers are pressed upwardly at an inclination away from their path of travel and at their inner reversal or turning point they are downwardly pressed. As a result, in the first mentioned case the grippers contact the warp threads at the upper shed and damage the same and, due to the action of these warp threads, the grippers are in fact even displaced out of the shed, whereas in the last-mentioned case both of the grippers which have been displaced within one another or interengaged can damage one another.

The attachment of the grippers at their insertion band is accomplished with the heretofore known gripper looms, in most instances, by soldering, but in a number of cases by thread connections or screws. Soldering requires a great amount of work and places extreme demands upon the precision of the workers or operating personnel. On the other hand, the local heating of the gripper and the insertion band, caused by the soldering operation, often results in distortion of the insertion band, which cannot or only with great difficulty be eliminated by performing a subsequent straightening or correction operation.

As to the economical operation of a loom, for a given weaving or cloth weave, the number of filling-thread insertions per minute, the so-called number of revolutions, is of decisive importance. The number of revolutions, in the case of band gripper looms, among other things, is limited by the relatively large mass of the grippers. This mass heretofore only could be slightly reduced, because the material used for the grippers, owing to the requirement that it be capable of being soldered with the insertion band or tape formed of steel, practically likewise was limited to steel.

The screwing or threading together of the gripper with the insertion bands was not heretofore accepted practice because, on the one hand, such type of screw connection did not have the requisite stability, and, on the other hand, the insertion bands at the region of the rather limited anchoring locations of the screws, generally only one but at most two anchoring locations of the screws, were exposed to an excessive wear.

SUMMARY OF THE INVENTION

Therefore, with the foregoing in mind it is a primary object of the present invention to provide a new and improved construction of a filling-thread insertion element for looms which is not associated with the aforementioned drawbacks and limitations of the prior art constructions.

Another more specific object of the present invention aims at improving upon the heretofore known insertion elements working with insertion bands and grippers attached thereto such that, on the one hand, there is reduced the rupture danger and also the tendency of the gripper to depart from its horizontal path of travel at its movement turning or reversal points.

Still a further significant object of the present invention, and in keeping with the immediately preceding object, is to design the filling-thread insertion element such that the gripper can be easily secured to the insertion band, without excessively impairing the stability of such attachment or excessively loading the insertion bands.

Yet a further significant object of the invention aims at providing a new and improved construction of filling-thread insertion element which possesses as low as possible mass and is simple and inexpensive both in the fabrication of the individual parts thereof as well as also during the assembly of such parts into the finished insertion elements.

Now in order to implement these and still further objects of the invention, which will become more readily apparent as the description proceeds, the invention contemplates that, on the one hand, the reinforcement element is releasablyconnected with the insertion band and, on the other hand, the gripper is releasably connected with the reinforcement element and/or the insertion band. Further, the gripper is formed of a material having a lower specific weight or density in relation to steel and at the region of its clamp is provided with an insert member formed of a material having greater wear resistance than the material of the gripper.

According to a preferred design the reinforcement element is connected by screws or equivalents fastening expedients with the insertion band and the gripper is connected by screws or equivalent fastening expedients with the reinforcement element and/or the insertion band.

By means of the inventive screw connection between the gripper-reinforcement element-insertion band the insertion element has imparted thereto the requisite stability and fulfils all of the requirements as concerns reliability during continuous operation. Additionally, the individual parts can be easily assembled together, something which appreciably renders less expensive the fabrication of the insertion elements and also the exchange of the grippers. Moreover, the inventive screw or threaded connection opens up a broad spectrum of materials which can be beneficially used and which heretofore could not be employed for the grippers. Now if there is used for the gripper, according to the invention, a material which is light in contrast to steel, then on the one hand there can be appreciably increased the number of filling-thread insertions per minute, the so-called number of revolutions, and, on the other hand, there can be reduced the cost of fabricating the grippers.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figures 1, 2, 3:
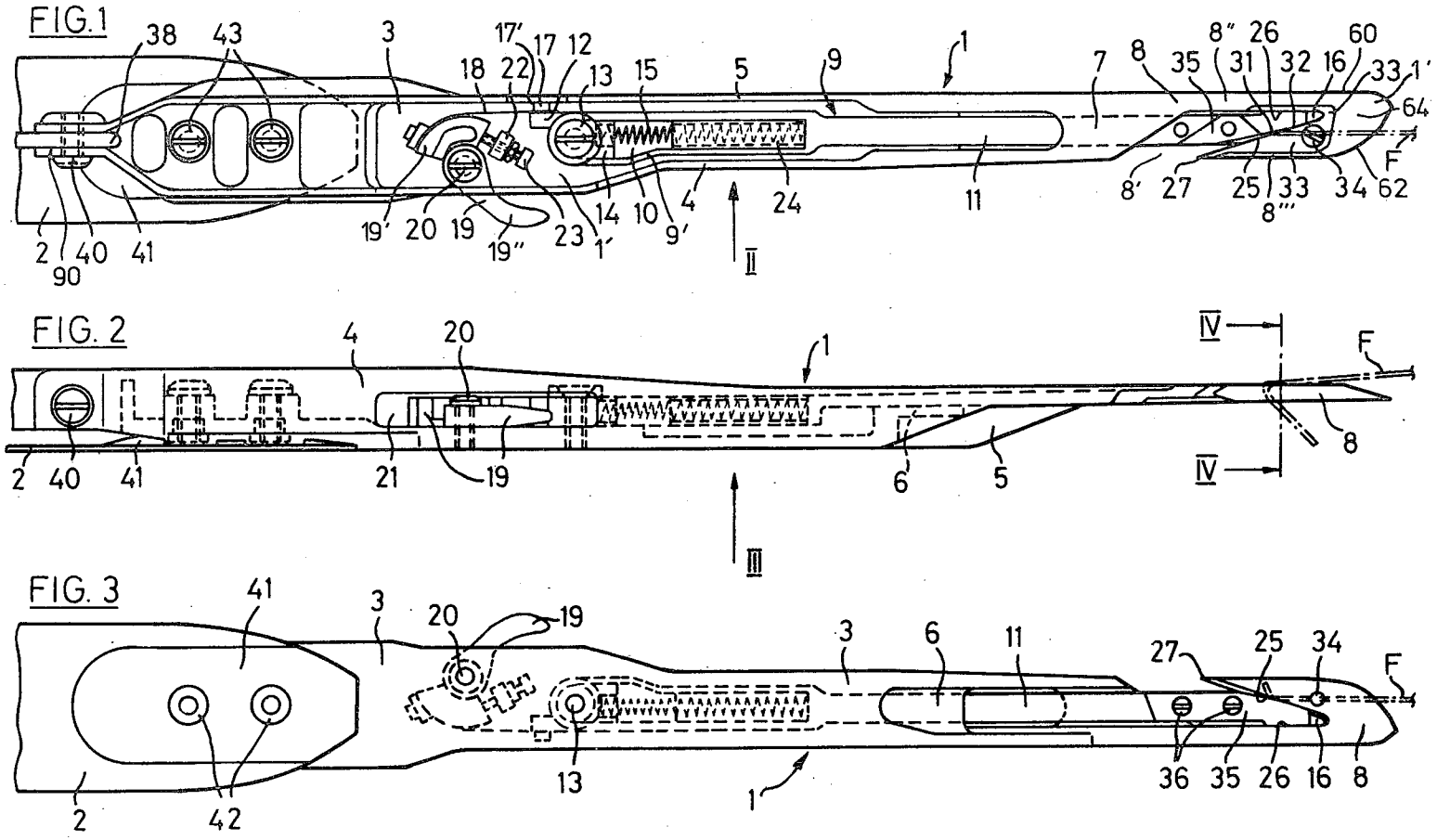
FIG. 1 is a top plan view of a taker-gripper or withdrawing carrier according to the invention.
FIG. 2 is a front view of the taker-gripper shown in FIG. 1, looking in the direction of the arrow II thereof.
FIG. 3 is a front view of the gripper of FIG. 2 looking in the direction of the arrow III thereof.
Figure 5:
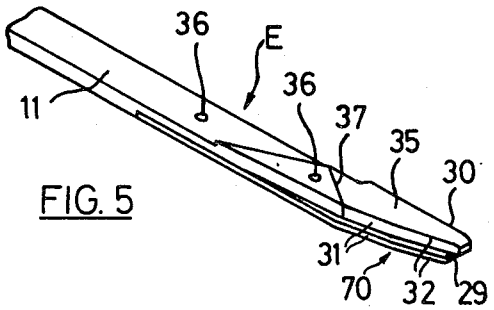
FIG. 5 is a fragmentary perspective view of a detail of a clamping tongue of the taker-gripper of FIG. 1.

Describing now the drawings, the taker-gripper 1 illustrated in FIGS. 1 to 5, which is mounted, as shown, at the front end of a flexible tape or band 2 serving for driving the taker-gripper 1 in a manner well known in this technology, will be seen to contain a lengthwise extended form of essentially U-shaped, cross-sectional configuration. At its rear portion, which is attached to the flexible tape or band 2, the taker-gripper 1 comprises a base portion 3, a first side wall 4 which confronts the cloth fell A, (FIG. 4), and a second side wall 5. The base or bottom portion 3 is closed towards the front in the direction of the gripper tip 1'' by a step-shaped raised portion or protuberance 6. Thereafter, both of the side walls 4 and 5 are connected with one another at the gripper top surface by a web 7 or the like and extend towards the gripper tip 1'' so as to finally form a substantially flat hook 8.

Internally of the hollow space 1' enclosed by the base portion 3, side walls 4 and 5, step-shaped-raised portion 6 and web 7, there is arranged a lengthwise extending or elongate clamping tongue 9 which is displaceable in the lengthwise direction of the taker-gripper 1. The clamping tongue 9 possesses at its rear portion or part, at the region of the base portion 3, a prismatic shape having an elongate, forwardly and rearwardly closed opening or throughpassage 10, at which merges, in the direction of the gripper tip 1'', an elongate, flat, band-like-portion 11. At the rear closure of the opening or throughpassage 10, there is formed an entrainment projection 12. The prismatic clamping tongue portion 9' containing the opening or throughpassage 10 bears upon the base portion 3 of the taker-gripper 1, while the band-shaped or band-like portion 11 of the clamping tongue 9 extends between the web 7 and the step-shaped raised portion 6.

Figure 4:
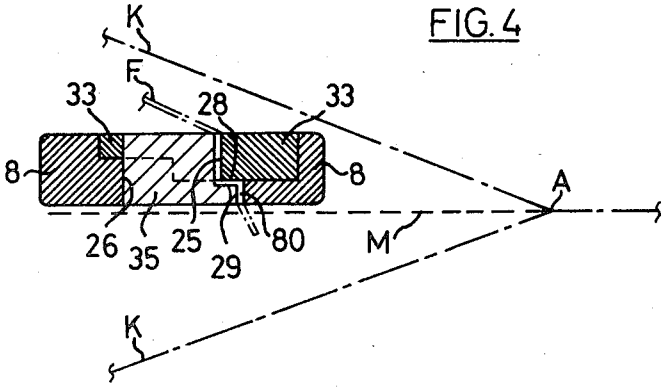
FIG. 4 is a sectional view, on an enlarged scale, of the taker-gripper shown in FIG. 2, the section being taken along the line IV—IV thereof.
Figure 6:
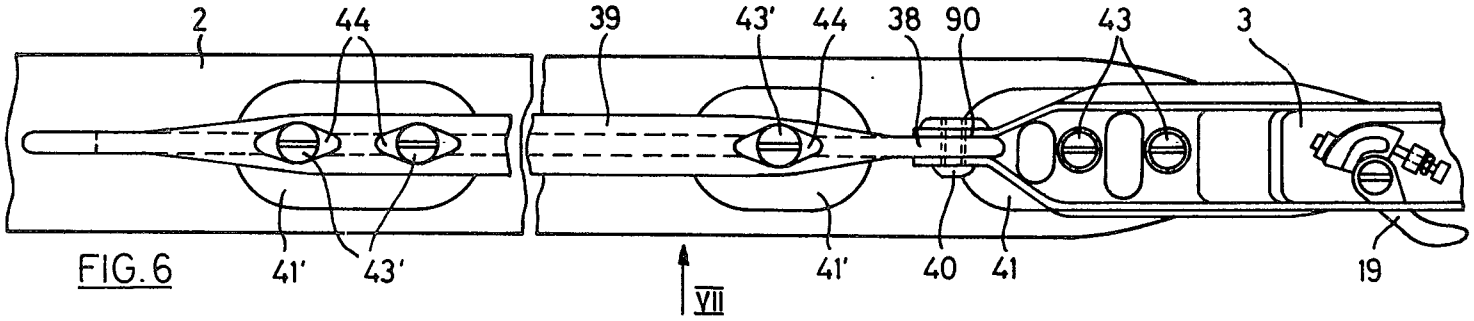
FIG. 6 is a top plan view showing details of a reinforcement element which is threadably connected to the rear end of the taker-gripper of FIG. 1 and to the flexible band.
Figure 7:
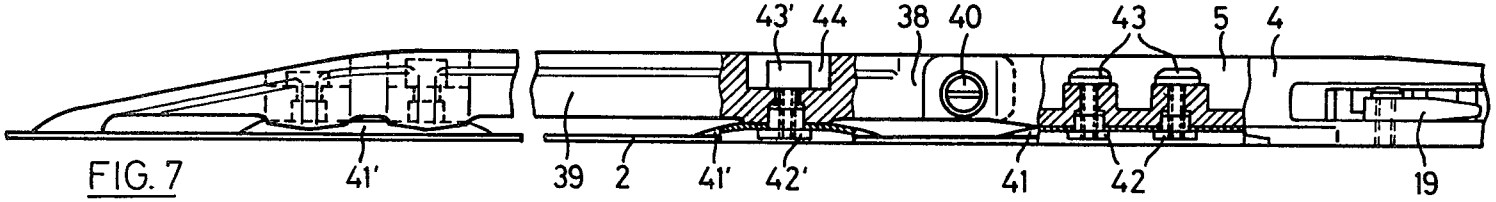
FIG. 7 is a front view of the arrangement of FIG. 6, and specifically showing details of the reinforcement element shown in such FIG. 6, looking in the direction of the arrow VII thereof.

During operation of the loom, the taker-gripper 1 is inserted from the left side of the loom into the shed; the flexible tape or band 2 and the plane of the hook 8 are located parallel to the central plane M of the wrap threads K (FIG. 4).

At the base portion 3 there is secured by means of a fastening screw or threaded bolt 13 or equivalent structure a guide element 14 which extends into the opening or throughpassage 10 and forms a guide for the rear part of the clamping tongue 9. In this guide element or piece 14 there is inserted the one end of a spiral spring 15 or equivalent structure, the other end of which presses against the front closure of the opening or throughpassage 10. By means of the spiral spring 15 the tip of the band-shaped part 11 of the clamping tongue 9 is thus pressed into the mouth of the hook 8.

At the entrainment shoulder 12 there is attached, by means of a fastening screw or threaded bolt 17 the one end of a blade or leaf spring 18 or equivalent structure, the other end of which is mounted at a double-arm pivotal lever 19. The second side wall 5 of the taker-gripper 1 is provided at the region of the screw or bolt 17 with an opening 17' rendering possible access to the screw 17. The pivotal lever 19 is pivotable about a screw or bolt 20 which is threaded into the base portion or part 3 and, as shown, consists of a circular sector-shaped portion or part 19' at which there is mounted the leaf spring 18, and an actuation finger 19'' which protrudes out of the gripper internal space or region 1', through an opening or passageway 21 provided at the first side wall 4.

This actuation finger 19'' is operatively associated at a location externally of the shed with a suitable stop or impact member (not shown), so that upon travel of the actuation finger 19'' against this stop, the clamping tongue 9 is drawn towards the rear, away from the gripper tip 1'', against the force of the spiral spring 15.

At the base portion 3 there is formed an upwardly protruding shoulder 22 into which there is threaded a screw or threaded bolt 23 or equivalent structure, constituting an adjustable stop for the circular sector-shaped portion 19' of the double-arm pivotal lever 19. In order to positively guide the spiral spring 15 in the opening 10 of the clamping tongue 9 there is adhesively bonded into the opening 10 a small tube or tubular element 24 which encloses the spiral spring 15 or the like.

The hook 8 is open at the first side wall 4, as generally indicated by reference character 8'. Both of the outer edges 60 and 62 of the hook arms 8'' and 8''' merge into the hook tip 64, whereas the inner edges 25 and 26 of both hook arms 8''' and 8'' limit the hook mouth 16. The hook end is designated by reference character 27. The inner edge 25 facing the cloth fell A is provided with a stepped portion 28, as best seen by referring to FIG. 4, and specifically such that the hook mouth 16 at the top side of the hook 8 is narrower than at its lower side.

The clamping tongue 9 protrudes by means of the free end E of its band-like portion 11 into the hook mouth 16 and is provided at the region of such end E, at its first lengthwise or longitudinal edge 70 neighboring the hook inner edge 25, likewise with a stepped portion 29. The second longitudinal or lengthwise edge 30 of the clamping tongue end E, which is more removed or distanced from the cloth fell A, serves as a guide edge. The first lengthwise or longitudinal edge 70 containing the stepped portion 29, forms together with the hook inner edge 25 and its stepped portion 28 a clamping gap 80 for a filling or weft thread F. The end E of the band-like part or portion 11 of the clamping tongue 9 is bevelled at its first lengthwise edge 70 and possesses a clamping surface 31 of lesser inclination for thicker yarns and a further clamping surface 22 of greater inclination for thinner yarns. Both of these clamping surfaces 31 and 32 can continuously merge into one another.

By means of the clamping surfaces 31 and 32 there is formed in the clamping gap 80 a wedge action, by means of which the filling thread F, independently of its thickness, is not only always positively fixedly clamped but also upon release of the clamping action is rapidly freed. The reliability of the clamping action is additionally increased by virtue of the stepped portion 28 at the hook inner edge 25 and the corresponding stepped portion 29 at the first lengthwise edge 70 at the end E of the clamping tongue 9.

The taker-gripper 1 and the clamping tongue 9 consist of a material having an appreciably lesser specific weight or density in relation to steel, and for instance, is cast from a light metal such as aluminum or an aluminum alloy or is fabricated of a suitable plastic material and at the region of the clamping gap 80 are each provided with wear-resistant inserts formed of a suitable steel or hard metal, such as carbide metal. Each of these inserts or insert members are preferably formed of one piece and are threadably connected with the hook 8 and with the end E of the clamping tongue 9, respectively. The insert element or member surrounding the hook mouth 16 has been generally designated by reference character 33, and as illustrated in FIGS. 1, 3 and 4, is mounted with the aid of a screw or bolt 34 from above at the hook 8. The clamping tongue 9 is stepped at the region of its end E at its underside, and at such stepped portion there is inserted from below the insert element or piece 35 and secured by means of two screws or bolts 36 at the end E (FIGS. 1, 3, 4, and 5). The base body of the clamping tongue 9 extends up to the line 37 and the insert element or piece 35 forms the tip of the end E of the clamping tongue 9.

The basic prerequisites for a free selection of the material of the taker-gripper 1 reside in the fact that such no longer need be soldered as previously was the case with the flexible tape or band 2, since with a steel band or tape only a relatively small amount of material can be soldered. It is for this reason that the taker-gripper 1 is secured by a threaded or screw connection at the flexible tape or band 2, which will be explained more fully hereinafter based upon the showing of FIGS. 1 to 3 and 6 and 7.

As illustrated, both of the side walls 4 and 5 of the taker-gripper 1 are guided towards one another at the region of the rear gripper end and limit by means of their inner surfaces a gap 90. In this gap 90 there protrudes the front end 38 of a rail-shaped reinforcement element 39. By means of a screw 40 or equivalent structure the side walls 4 and 5 are fixed at the end 38 of the reinforcement element 39. Additionally, the taker-gripper 1 is threadably connected with the flexible band or tape 2. The band 2 is provided at its front end with an upwardly domed bead or pleat 41 in which there is inserted from below the nut members 42 by means of which there is threadably connected the screws 43 which are inserted from above through the base portion 3 of the taker-gripper 1.

The reinforcement element 39 is of rail-like configuration and is provided over its length with a number of vertical bores 44 serving for receiving the attachment screws 43'. The taker-gripper 1 and the reinforcement element 39 are fabricated of the same material and have approximately the same length. The reinforcement element 39 is placed in an upright position and is threadably connected with the flexible band or tape 2 along the central axis of such flexible band. For this purpose, the band 2 is provided at the location of the bores 44 of the reinforcement element 39 with reinforcing fins 41' in the form of the beads or pleats 41, serving for taking-up nuts 42' or the like. For assembling the taker-gripper 1 at the band 2, the taker-gripper 1 is initially threadably connected by means of the screw 40 or the like with the reinforcement element 39 and thereafter the pair of elements forming a unit, namely the taker-gripper 1 and the reinforcement element 39, are threaded to the band or tape 2 by means of the screws 43' and nuts 42'.

The mode of operation of the taker-gripper 1 is as follows: This taker-gripper 1 is transported by its band 2 from the left side of the loom up to approximately the center of the shed and at that location, at the region of the hook tip 27 engages by means of the outer edge 25 of the hook 8 which confronts the cloth fell A with the filling thread F which has been offered by a not particularly illustrated bringer-gripper in a position extending perpendicular to the plane of the hook 8. The taker-gripper 1 moves into the bringer-gripper, in a manner well-known in this technology. As a result, the filling thread F which is still fixedly retained by the bringer-gripper now slides over the aforementioned outer edge 25 of the hook 8 and the hook end 27 in the direction of the clamping gap 80. During the outward movement of the taker-gripper 1, out of the weaving shed, the filling thread F arrives at the clamping gap 80 and specifically, up to the zone or region which corresponds to its thickness. At this moment, the clamping action of the bringer-gripper is released, and the filling thread F which is now fixedly clamped by the taker-gripper 1 is pulled by such taker-gripper 1 through the second half of the shed. After completion of the insertion of the filling thread F through the shed there is released the clamping action of the taker-gripper 1 at the filling thread F by virtue of the travel of the actuation finger 19″ of the pivotal lever 19 against the aforementioned stationary stop or impact member and the filling thread F is totally released.

Since the constructional details of the gripper are not important as far as the specific teachings of this invention are concerned, the invention is not limited to taker-grippers, rather also has applicability for bringer-grippers. Both types of grippers need not, of course, possess a displaceable clamping tongue, rather also can be provided with a horizontally or vertically pivotable clamping tongue.

While there are shown and described present preferred embodiments of the invention, it is to be distinctly understood that the invention is not limited thereto, but may be otherwise variously embodied and practised within the scope of the following claims. Accordingly,

What I claim is:

1. A filling thread-insertion element for looms working with removal of the filling thread from stationary bobbins, comprising:

a flexible insertion band;

a gripper driven by said flexible insertion band;

a clamping element provided for said gripper for fixedly clamping a filling thread;

a reinforcement element arranged at the insertion band at a region thereof merging with said gripper;

means for releasably connecting the reinforcement element with the insertion band;

means for releasably connecting said gripper with said reinforcement element and said insertion band;

said gripper being formed of a material having a specific weight which is lower than the specific weight of steel;

an insert element provided for said gripper at the region of its clamping element; and said insert element being formed of a material which is wear-resistant in relation to the material from which there is formed said gripper.

2. The filling thread-insertion element as defined in claim 1, wherein:

said means for connecting the reinforcement element with the insertion band comprises screw means; and said means for connecting said gripper with said reinforcement element and said insertion band, comprises screw means.

3. The filling thread-insertion element as defined in claim 2, wherein:

said reinforcement element is formed of the same material as the gripper.

4. The filling thread-insertion element as defined in claim 1, wherein:

said gripper is formed of a plastics material.

5. The filling thread-insertion element as defined in claim 1, wherein:

said gripper is formed of a light metal.

6. The filling thread-insertion element as defined in claim 5, wherein:

said insert element is formed of hard metal.

7. The filling thread-insertion element as defined in claim 6, wherein:

said clamping element is formed by a fixed stop and a movable clamping tongue; and said insert element constitutes said fixed stop.

8. The filling thread-insertion element as defined in claim 7, wherein:

said insert element possesses a substantially plate-like configuration; and means for releasably connecting said insert element with said gripper.

9. The filling thread-insertion element as defined in claim 8, wherein:

said clamping tongue is formed of the same material as said gripper; and an insert element formed of a wear-resistant material provided for said clamping tongue at a region of its clamping end.

10. The filling thread-insertion element as defined in claim 9, wherein:

said insert element of said clamping tongue is formed of hard metal.

11. The filling thread-insertion element as defined in claim 10, wherein:

said insert element of said clamping tongue has a substantially plate-shaped configuration; and means for releasably connecting said insert element with said clamping tongue; and said insert element of said clamping tongue forming its clamping end.

* * * * *